US006609810B2

(12) United States Patent
Kim

(10) Patent No.: US 6,609,810 B2
(45) Date of Patent: Aug. 26, 2003

(54) ILLUMINATION APPARATUS WITH REMOVABLY SECURABLE SWITCH DEVICE

(75) Inventor: Paul Y. Kim, Irvine, CA (US)

(73) Assignee: Surefire, LLC, Fountain Valley, CA (US)

( * ) Notice: Subject to any disclaimer, the term of this patent is extended or adjusted under 35 U.S.C. 154(b) by 0 days.

(21) Appl. No.: 10/050,320

(22) Filed: Jan. 15, 2002

(65) Prior Publication Data

US 2003/0133286 A1 Jul. 17, 2003

(51) Int. Cl.[7] ..... F41G 1/34; F21L 4/02; F21V 23/04

(52) U.S. Cl. ..... 362/110; 362/184; 362/206; 362/394; 200/6 R; 200/553; 439/320; 439/378

(58) Field of Search ..... 362/110, 114, 362/184, 205, 206, 251, 394, 395; 200/6 R, 18, 1 B, 339, 553; 439/320, 322, 323, 313, 374, 378, 680; 42/117, 146

(56) References Cited

U.S. PATENT DOCUMENTS

| | | | | | |
|---|---|---|---|---|---|
| 2,523,786 | A | | 9/1950 | Soreng | 200/438 |
| 3,086,090 | A | | 4/1963 | Carroll | 200/5 E |
| 4,048,631 | A | * | 9/1977 | Flores | 362/184 |
| 4,500,154 | A | * | 2/1985 | Collins | 439/313 |
| 4,533,980 | A | * | 8/1985 | Hayes | 362/110 |
| 4,782,432 | A | * | 11/1988 | Coffman | 362/184 |
| 4,918,264 | A | * | 4/1990 | Yamamoto et al. | 200/6 R |
| 5,064,988 | A | | 11/1991 | E'nama et al. | 219/121.6 |
| 5,136,132 | A | | 8/1992 | Kitchen | 200/525 |
| 5,161,879 | A | * | 11/1992 | McDermott | 362/206 |
| 5,400,540 | A | | 3/1995 | Solinsky et al. | 42/115 |
| 5,504,286 | A | * | 4/1996 | Tsai | 200/339 |
| 5,558,211 | A | | 9/1996 | Heydner et al. | 200/553 |
| 5,842,775 | A | * | 12/1998 | Roorda et al. | 362/394 |
| 5,902,972 | A | * | 5/1999 | Nestor et al. | 200/1 B |
| 5,945,645 | A | | 8/1999 | Makuc et al. | 200/5 E |
| 6,276,088 | B1 | | 8/2001 | Matthews | 42/1.03 |
| 6,318,880 | B1 | * | 11/2001 | Siminovitch et al. | 362/251 |
| 6,345,464 | B1 | | 2/2002 | Kim et al. | 42/114 |

* cited by examiner

*Primary Examiner*—Alan Cariaso
(74) *Attorney, Agent, or Firm*—David Weiss

(57) ABSTRACT

An electrical appliance having a removably securable switch device, a preferred embodiment of which is an illumination apparatus for being mounted to a firearm and which includes a switch device mechanically and electrically removable from an illuminator device. The removable switch device preferably includes two momentary switches which, when the switch device is mechanically and electrically secured to the illuminator device, may be manually actuated for causing energization of either of two light sources or of both light sources simultaneously.

21 Claims, 2 Drawing Sheets

ILLUMINATION APPARATUS WITH REMOVABLY SECURABLE SWITCH DEVICE

BACKGROUND OF THE INVENTION

This invention relates to switchable electrical appliances including target illuminators for firearms, and more particularly to electrical appliances including an illumination apparatus with a removably securable switch device.

Illumination apparatus for being mounted to firearms are well known. Such illuminators include one or more light sources that may be selectively energized for illuminating a target or for other tactical purposes.

One such firearm illumination apparatus, disclosed in U.S. patent application Ser. No. 09/878,709 by the present inventor, includes a high intensity light source and a low intensity light source that are selectively switchable for either illuminating a target by energization of the high intensity light source or for illuminating the user's surroundings upon energization of the low intensity light source. Application Ser. No. 09/878,709 is incorporated herein by reference.

In firearm illumination apparatus of the prior art which includes two switchable light sources, one or the other of the two light sources are energized by switches normally permanently carried by the illuminator's housing.

SUMMARY OF THE INVENTION

The present invention provides an illumination apparatus for being mounted to a firearm, and including a switch device for operating one, or the other, or both of two light sources carried by the illuminator device, which switch device is removably securable to the illuminator device.

According to one aspect of a preferred embodiment of the invention, an illumination apparatus for a firearm is provided that comprises the combination of: a housing adapted to be secured to the firearm; a first light source carried by the housing; a second light source carried by the housing; a battery carried by the housing in circuit for energizing the light sources when switch actuated; and a switch device removably securable to the housing, the switch device including a first momentary switch and a second momentary switch connected in the circuit when the switch device is secured to the housing, the switch device including a switch actuator having a first position for actuating the first momentary switch to cause the first light source to be energized by the battery, a second position for actuating the second momentary switch to cause the second light source to be energized by the battery, and a third position for simultaneously actuating the first and second momentary switches to cause the first and second light sources to be energized by the battery.

In a preferred configuration, the illuminator device housing includes a pair of cylindrical segments projecting therefrom and separated by a longitudinal slot, the segments encircling electrical contacts of the circuit; the switch device includes a wall having arcuate openings therethrough and about electrical contacts of the first and second momentary switches, the arcuate openings for receiving the segments and effecting contact between the contacts of the wall and the contacts of the housing; and a knob adapted to cooperate with the segments for securing the wall to the housing when the segments are received by the arcuate openings. The switch device includes a pin projecting from the wall of the switch device, and the housing includes a bore receiving the pin when the cylindrical segments are received by the arcuate openings.

The switch device includes a frame and pivot shaft secured to the frame, with the first and second momentary switches supported by the frame on opposite sides of the pivot shaft; and a switch actuator which includes first and second wings extending from opposite sides of a longitudinal spine pivotable about the pivot shaft in a first rotational direction when a first force is applied to the first wing for actuating the first momentary switch, the spine being pivotable about the pivot shaft in a second rotational direction when a second force is applied to the second wing for actuating the second momentary switch, the actuator being translatable when a third force is applied to the spine for simultaneously causing the first wing to actuate the first momentary switch and the second wing to actuate the second momentary switch. The switch actuator includes at least one collar (and preferably two longitudinally spaced-apart collars) along the spine pivotally supported with respect to the pivot shaft, the inside diameter of the collars being greater than the diameter of the pivot shaft for effecting rolling contact between the collars and the pivot shaft when the first force is applied to the first wing and alternatively when the second force is applied to the second wing, and for effecting translation of the collars with respect to the pivot shaft when the third force is applied to the spine.

According to another aspect of the present invention, an illumination apparatus comprises: a housing adapted to be secured to a firearm; a light source carried by the housing; a battery carried by the housing in circuit for energizing the light source when switch actuated; cylindrical segments projecting from the housing and separated by a longitudinal slot, the segments encircling electrical contacts of the circuit; a switch device removably securable to the housing, the switch device including a switch connected in the circuit when the switch device is secured to the housing, the switch device including a wall having arcuate openings therethrough and about electrical contacts of the switch, the arcuate openings for receiving the segments and effecting contact between the contacts of the wall and the contacts of the housing; and a knob adapted to cooperate with the segments for securing the wall to the housing when the segments are received by the arcuate openings. The switch device includes a pin projecting from the wall of the switch device, and the housing includes a bore receiving the pin when the cylindrical segments are received by the arcuate openings.

The present invention is applicable to other types of electrical appliances in which at least one electrical device is carried by a housing, and in which the switch device is removably securable to the housing for effecting switching of the electrical devices when the switch device is secured to the housing.

BRIEF DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
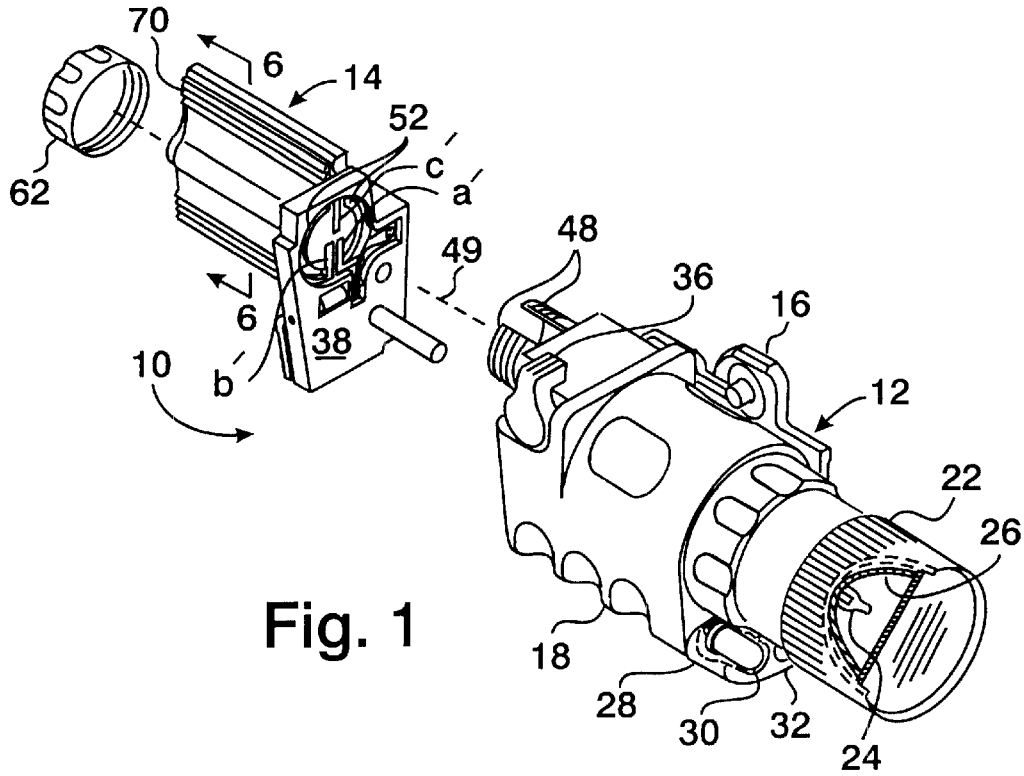
FIG. 1 is a generally front and right side perspective view, partially broken away, of a preferred embodiment of an illumination apparatus having a detachable switch device according to the present invention, the switch device shown detached from the illuminator device of the illumination apparatus.
Figure 2:
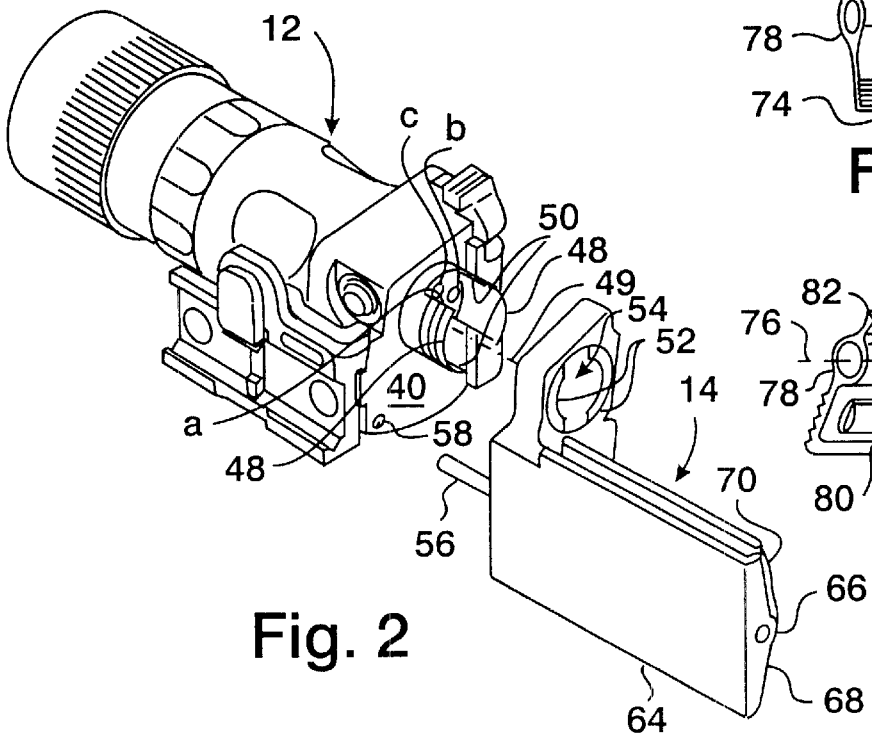
FIG. 2 is a generally rear and left side perspective view of the switch device and illuminator device of FIG. 1, the switch device shown detached from the illuminator device of the illuminator device.
Figure 3:
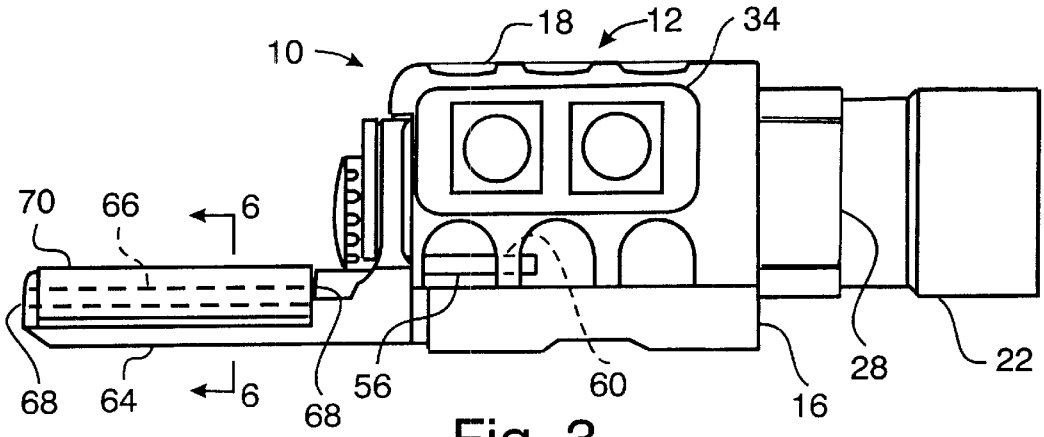
FIG. 3 is a bottom plan view of the illumination apparatus of FIG. 1, shown with the switch device and illuminator device in assembled condition.

Turning to FIGS. 1, 2 and 3, there is shown a preferred embodiment of an electrical appliance according to the present invention, specifically a preferred embodiment of an illumination apparatus 10 including an illuminator device 12 and a switch device 14. The illuminator device 12 preferably is adapted to be secured to a firearm, and for this purpose includes a mounting plate assembly 16 for mounting the illuminator device 12 to a rail interface system device of which the firearm is equipped; such rail interface system devices and mounting plates for use therewith are well known in the firearms art, such as those manufactured by Knights Manufacturing Company (of Vero Beach, Fla.).

Figure 10:
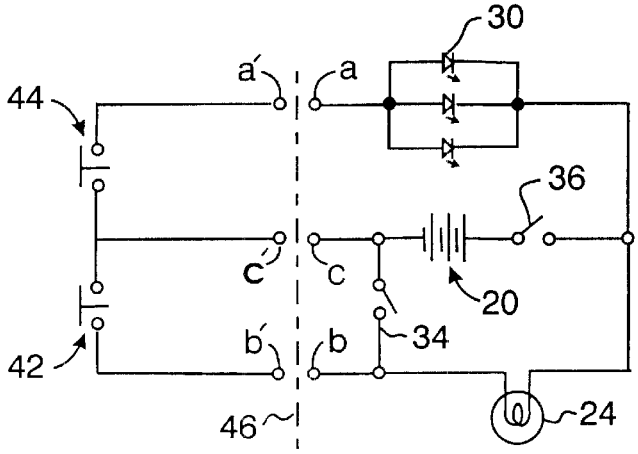
FIG. 10 is a schematic diagram of an electrical circuit included in the preferred embodiment of the present invention.

The illuminator device 12 includes a housing 18 in which is contained a power source such as a battery 20 (see FIG. 10) of one or more battery cells. The forward portion of the housing 18 accommodates a first or high intensity light source assembly 22 for illuminating a target and which may include an electric filament lamp 24 in a parabolic reflector 26; such light source assembly 22 may be of the type described in U.S. patent application Ser. No. 09/229,915, of Paul Y. Kim and John W. Matthews, which application is incorporated herein by reference.

The forward portion of the housing 18 further includes a second light source assembly, such as a low intensity light source assembly 28 preferably including at least one light emitting diode or LED 30 with conventional resistor and regulator combination secured in the housing front portion that includes apertures or windows 32 for permitting the LEDs 30 to emit light therethrough. The low intensity illumination produced by the LEDs 30 may be for permitting the user to navigate in otherwise unlighted or dark surroundings, or the LEDs 30 may be of a specialized type such as for emitting colored light within or outside the visible frequency range that may be useful in certain environments. Although filament bulbs or other types of lamps may be used instead of the LEDs, LEDs are preferred because of their low energy consumption and long life.

The illuminator device 12 preferably includes a constant ON/OFF switch 34 (FIGS. 3 and 10) for the high intensity light source assembly 22, such as a bistable rocker switch 34 described, for example, in the aforementioned U.S. patent application Ser. No. 09/229,915, as well as an enable/disable switch assembly 36 (FIGS. 1 and 10) for enabling and disabling the battery so as to permit or prevent energization of the light sources upon actuation of other switches carried by the illuminator housing 18 (such as the rocker switch 34) or by the detachable switch device 14 when attached to the housing 18 as described below.

The detachable switch device 14 of the present invention, when attached to the illuminator device 12, may be operated by a user to momentarily switch on the electric lamp 24 of the first or high intensity light source assembly 22, or alternatively to momentarily switch on the second or low intensity light source or LEDs 30, or to momentarily switch on both of the light sources 22 and 30 simultaneously.

The detachable switch device 14 is both electrically connectable and mechanically securable to the illuminator device 12, the electrical connection being automatically implemented when the mechanical securement is engaged. In the preferred embodiment, the detachable switch device 14 includes a forwardly facing wall 38 for engaging a rearwardly facing wall 40 of the housing 18 of the illuminator device 12. The housing wall 40 carries a rearwardly facing circuit board having electrical contacts a, b, c connected in circuit to the battery 20 and to the first and second light sources 24 and 30, the contacts a, b, c situated for contacting respective forwardly facing electrical contacts a', b', c' carried by the switch device 14 connected to first and second momentary tape switches 42 and 44. This circuit arrangement is shown in the circuit diagram of FIG. 10, wherein the elements to the right of imaginary line 46 are carried by the illuminator device 12 and the elements to the left of line 46 are carried by the detachable switch device 14. When the switch device 14 is mechanically secured to the illuminator device 12 in accordance with the present invention, the contact a is in electrical contact with the contact a', the contact b is in electrical contact with the contact b', and the contact c is in electrical contact with the contact c'.

Mechanical securement of the detachable switch device 14 to the illuminator housing 18, such that the contacts a, b, c and the contacts a', b', c' are in proper electrical contact engagement, is implemented by a coupler including releasably cooperating components of the housing 18 and the switch device 14. In a preferred configuration of such coupler, a pair of externally threaded cylindrical segments 48 having a longitudinal axis 49 and encircling the contacts a, b, c, project rearwardly from the wall 40 of the illuminator housing 18, the segments 48 being separated by a longitudinal slot 50. A pair of arcuate openings 52 through the wall 38 of the switch device 14 is situated about the contacts a', b', c', the respective ends of the arcuate openings 52 being separated by a wall portion 54 for being received by the slot 50 while the cylindrical segments 48 are received by the arcuate openings 52. A pin 56, longitudinally projecting forwardly from the wall 38 of the switch device 14 and preferably offset laterally and vertically from the center of the arcuate openings 52, is longitudinally insertable in a longitudinal bore 58 through the illuminator device wall 40 and extending into the illuminator housing 12 such as through a second longitudinal bore 60 (shown in phantom in FIG. 3) aligned with the bore 58. The cylindrical segments 48 projecting from the housing 18 are in registration with the arcuate openings 52 in the switch device 14 while the pin 56 is longitudinally (i.e. parallel to the longitudinal axis 49) inserted through the bore 58, such that the contacts a, b, c are in proper electrical contact engagement with the contacts a', b', c' and the switch device 14 is restrained against lateral rotational movement relative to the illuminator housing 18 when the switch device 14 is longitudinally moved toward the illuminator housing 18 until the walls 38 and 40 are in contact engagement. At this point, the externally threaded cylindrical segments 48 longitudinally project through the arcuate openings 52 in the switch device wall 38, and the switch device 14 is longitudinally secured to the illuminator housing 18 by installing an internally threaded knob 62 to the projecting externally threaded cylindrical segments 48 and tightening the knob 62 against the rear face of the wall 38.

The switch device 14 may be removed from the illuminator housing 18 by unscrewing the knob 62 and longitudinally withdrawing the switch device 14 rearwardly from the housing 18, whereupon the knob 62 may be screwed back onto the cylindrical segments 48. The illuminator device 12 may be used without the switch device 14 attached thereto; i.e., the first light source may be turned ON or turned OFF by actuation of the constant ON/OFF switch 34, although in the present embodiment shown in the circuit of FIG. 10 the second light source 30 is not energizable when the switch device 14 is detached from the illuminator device 12.

Figure 4:
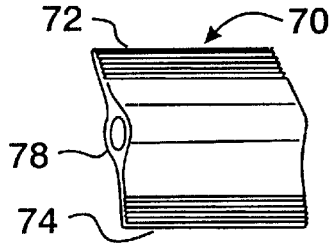
FIG. 4 is a generally right or outwardly facing side perspective view of the switch actuator shown in FIGS. 1–3.
Figure 5:
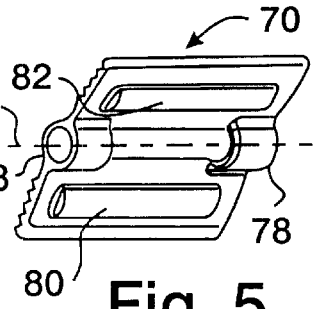
FIG. 5 is a perspective view of the inner side of the switch actuator of FIG. 4.
Figure 6:
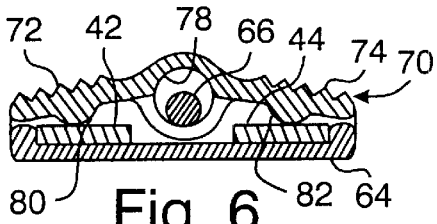
FIG. 6 is a cross-sectional view of the switch device shown in FIGS. 1, 2 and 3, taken along the line 6—6 of FIGS. 1 and 3 in the direction of the appended arrows, the switch device shown in its unactuated condition.

Considering FIGS. 4, 5 and 6 along with FIGS. 1, 2, 3 and 10, the detachable switch device 14 includes a frame 64 rearwardly extending from the wall 38 and having a pivot shaft 66 secured between upstanding (as viewed in FIG. 3) ends 68 of the frame 64. A pair of momentary tape switches 42 and 44 are supported on the frame 64, along and on opposite sides of the pivot shaft 66. Momentary switches are well known in the art and include the so-called tape switches used in firearm systems, providing the firearm user with instantaneous light control. Their construction typically includes spaced electrodes in a flexible enclosure that are squeezed together and thus brought into electrical contact with each other by the user when energization of an electrical device such as a light source is desired, through conventional electrical circuitry including the normally spaced electrodes.

Actuation of the tape switches 42, 44 is implemented by a switch actuator 70 which may be selectively urged to effect actuating pressure contact with the tape switches 42 and/or 44. As best shown in FIGS. 4, 5 and 6, the switch actuator 70 includes a pair of wings 72, 74 laterally extending from a longitudinal ridge or spine 75, the spine 75 extending along a longitudinal axis 76 (which may be parallel to the longitudinal axis 49 when the switch device 14 is secured to the illuminator device 18) through at least one collar 78 and preferably two longitudinally spaced-apart collars 78. The collars 78 each have an inside diameter significantly greater than the outside diameter of the pivot shaft 66 which carries the collars 78 longitudinally thereabout thereby pivotally retaining the switch actuator 70 to the frame 64. A pair of projections 80, 82 project from the underside of the switch actuator 70 (FIG. 5) longitudinally extending along either side of the longitudinal axis 76 and laterally spaced from the collars 78. When the switch actuator 70 is in its unactuated condition as shown in FIG. 6, the projections 80, 82 may be resting upon (although not applying actuating pressure to) the tape switches 42, 44, respectively, while the lowermost inner surface of the collars 78 (as viewed in FIG. 6) is in contact with the lowermost surface of the fixed pivot shaft 66 and with their longitudinal axes vertically aligned.

Figure 7:
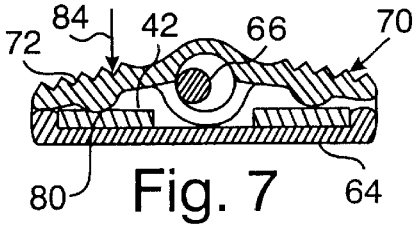
FIG. 7 is the same view of the switch device as in FIG. 6, showing the switch device in a first actuated condition for switching on one electrical light source of the illuminator device.

When it is desired to energize the first light source 24 through operation of the switch device 14 attached to the illuminator device 12, the user urges the switch actuator 70 into a first actuating position by manually applying a force (indicated by the arrow 84 in FIG. 7) or pressing the first wing 72 of the actuator 70 toward the frame 64, causing the actuator 70 to pivot about the pivot shaft 66 with the inside circumferential surface of the collars 78 making rolling contact with the fixed pivot shaft 66 and pivoting counterclockwise (as viewed in FIG. 7). The resulting switch actuation force or pressure applied to the first tape switch 42 by the first projection 80 completes the circuit between the battery 20 and the lamp 24 thereby energizing the lamp 24. The lamp 24 remains energized until the user releases the manually applied force, whereupon the lamp 24 is de-energized.

Figure 8:
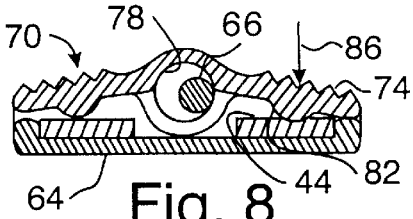
FIG. 8 is the same view of the switch device as in FIG. 6, showing the switch device in a second actuated condition for switching on a second electrical light source of the illuminator device.

Similarly, the second light source 30 is energized when the user urges the actuator 70 to a second actuating position by manually applying a force 86 to the second wing 74 of the switch actuator 70, as shown in FIG. 8, causing the switch actuator 70 to rotate clockwise about the pivot shaft 66 as the inside circumferential surface of the collars 78 make rolling contact with the fixed pivot shaft 66. This results in the application of actuating force or pressure to the second tape switch 44, completing the circuit between the battery 20 and the second light source 30, causing the second light source 30 to be energized until the user releases the force 86.

Figure 9:
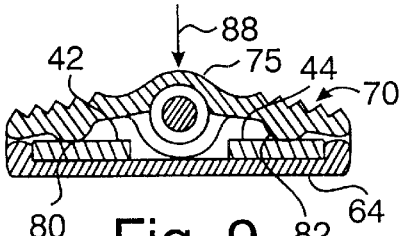
FIG. 9 is the same view of the switch device as in FIG. 6, showing the switch device in a third actuated condition for switching on both electrical light sources of the illuminator apparatus.

When it is desired to energize both light sources 24 and 30 simultaneously, the user urges the actuator 70 to a third actuating position by manually applying a force 88 upon the spine 75 (FIG. 9), toward the frame 64, thereby causing the entire switch actuator 70 including both projections 80, 82 to travel toward and into pressure actuating engagement with both of the tape switches 42 and 44. Both of the light sources 24 and 30 are accordingly energized, and remain energized until the user releases the manually applied force 88 from the spine 75. Although the user may manually apply the forces 84 and 86 (FIGS. 7 and 8) simultaneously to the respective wings 72, 74 to energize both light sources 24, 30, the ability to energize both light sources by manually applying a single force 88 to the spine 75 provides increased ease of operation of the switch device 14 since the manual application and release of two actuating forces by manipulation of two of the user's fingers is avoided.

The inside diameter of the collars 78 and the outside diameter of the pivot shaft 66 relative to each other are such that the collar inside circumferential surface makes rolling contact with the fixed pivot shaft 66 when a force is applied to either one of the wings 72 or 74 for actuating one of the tape switches 42 or 44, and for permitting translational travel of the spine 75 toward the frame 64 for actuating both tape switches 42 and 44 simultaneously. In one example, the inside diameter of the collars 78 was approximately 0.250 inch and the diameter of the pivot shaft 66 was approximately 0.158 inch. Although the inside circumference of each collar 78 is circular in the preferred embodiment, it may be appreciated that other inside circumferential configurations are possible such as an elliptical configuration with its major diameter preferably normally perpendicular to the plane of the tape switches 42, 44.

The various components of the electrical apparatus 10 of the present invention may be fabricated in accordance with known fabrication techniques and of materials conventional in the firearm illuminator art. For example, the illuminator housing 18 and the frame 64 and wall 38 of the detachable switch device 14 may be fabricated of metal such as aluminum, while the pin 56 and the pivot shaft 66 are preferably of stainless steel. Although the switch activator 70 and the knob 62 may be fabricated of a metal such as aluminum, it is preferred that these components 70 and 62 be fabricated of a polymeric material such as nylon.

Thus, there has been described a preferred embodiment of an electrical appliance having a removably securable switch device, and specifically a preferred embodiment of an illumination apparatus for being mounted to a firearm and which includes a switch device mechanically and electrically removable from an illuminator device. In its preferred embodiment, the removable switch device includes two momentary switches that may be manually actuated for causing energization of either of two light sources or of both light sources simultaneously. Other embodiments of the present invention, and variations of the embodiments described herein, may be developed without departing from the essential characteristics thereof. Accordingly, the invention should be limited only by the scope of the claims listed below.

I claim:

1. An illumination apparatus for a firearm, comprising the combination of:

a housing adapted to be secured to the firearm;

a first light source carried by said housing;

a second light source carried by said housing;

a battery carried by said housing in circuit for energizing said light sources when switch actuated; and a switch device removably secured to said housing, said switch device including a first momentary switch connecting said first light source to said battery when actuated and a second momentary switch connecting said second light source to said battery when actuated, said switch device including a switch actuator having a first position for actuating said first momentary switch, a second position for actuating said second momentary switch, and a third position for simultaneously actuating said first and second momentary switches.

2. The illumination apparatus according to claim 1, including:

a constant ON/OFF switch carried by said housing for connecting said first light source to said battery independently of said switch device.

3. The illumination apparatus according to claim 1, wherein:

said housing includes cylindrical segments projecting therefrom and separated by a longitudinal slot, said segments encircling electrical contacts of said circuit;

said switch device includes a wall having arcuate openings therethrough and about electrical contacts of said first and second momentary switches, said arcuate openings for receiving said segments and effecting contact between said contacts of said wall and said contacts of said housing; and a knob adapted to cooperate with said segments for securing said wall to said housing when said segments are received by said arcuate openings.

4. The illumination apparatus according to claim 3, wherein:

said switch device includes a pin projecting from said wall of said switch device; and said housing includes a bore receiving said pin when said cylindrical segments are received by said arcuate openings.

5. The illumination device according to claim 1, wherein:

said switch device includes a frame and a pivot shaft secured to said frame, said first and second momentary switches supported by said frame on opposite sides of said pivot shaft; and said switch actuator includes first and second wings extending from opposite sides of a longitudinal spine pivotable about said pivot shaft in a first rotational direction when a first force is applied to said first wing for actuating said first momentary switch, said spine being pivotable about said pivot shaft in a second rotational direction when a second force is applied to said second wing for actuating said second momentary switch, said actuator being translatable when a third force is applied to said spine for simultaneously causing said first wing to actuate said first momentary switch and said second wing to actuate said second momentary switch.

6. The illuminator apparatus according to claim 5, wherein:

said switch actuator includes at least one collar along said spine pivotally supported with respect to said pivot shaft.

7. The illuminator apparatus according to claim 6, wherein:

an inside diameter of said at least one collar is greater than the diameter of said pivot shaft for effecting rolling contact between said at least one collar and said pivot shaft when the first force is applied to said first wing and alternatively when the second force is applied to said second wing, and for effecting translation of said at least one collar with respect to said pivot shaft when the third force is applied to said spine.

8. An illumination apparatus for a firearm, comprising the combination of:

a housing adapted to be secured to the firearm;

a light source carried by said housing;

a battery carried by said housing in circuit for energizing said light source when switch actuated;

cylindrical segments projecting from said housing and separated by a longitudinal slot, said segments encircling electrical contacts of said circuit;

a switch device removably securable to said housing, said switch device including a switch connected in said circuit when said switch device is secured to said housing, said switch device including a wall having arcuate openings therethrough and about electrical contacts of said switch, said arcuate openings for receiving said segments and effecting contact between said contacts of said wall and said contacts of said housing; and a knob adapted to cooperate with said segments for securing said wall to said housing when said segments are received by said arcuate openings.

9. The illumination apparatus according to claim 8, wherein:

said switch device includes a pin projecting from said wall of said switch device; and said housing includes a bore receiving said pin when said cylindrical segments are received by said arcuate openings.

10. In a switch device, the combination comprising:

a frame;

a pivot shaft secured to said frame;

a first momentary tape switch and a second momentary tape switch, said first and second momentary tape switches supported by said frame on opposite sides of said pivot shaft; and a switch actuator including first and second wings extending from opposite sides of a longitudinal spine pivotable about said pivot shaft in a first rotational direction when a force is applied to said first wing for applying actuating pressure to said first momentary tape switch, said spine being pivotable about said pivot shaft in a second rotational direction when a second force is applied to said second wing for applying actuating pressure to said second momentary tape switch, said actuator being translatable when a third force is applied to said spine for simultaneously causing said first wing to apply actuating pressure to said first momentary tape switch and said second wing to apply actuating pressure to said second momentary tape switch.

11. The switch device according to claim 10, wherein:

said switch actuator includes at least one collar along said spine pivotally supported with respect to said pivot shaft.

12. The switch device according to claim 11, wherein:

an inside diameter of said at least one collar is greater than the diameter of said pivot shaft for effecting rolling contact between said at least one collar and said pivot shaft when the first force is applied to said first wing or alternatively when the second force is applied to said second wing, and for effecting translation of said at least one collar with respect to said pivot shaft when the third force is applied to said spine.

13. An electrical appliance, comprising the combination of:

a housing including cylindrical segments projecting therefrom and separated by a longitudinal slot, said segments encircling electrical contacts of said circuit;

a first electrical device carried by said housing;

a second electrical device carried by said housing;

an electrical circuit carried by said housing for energizing said electrical devices by an electrical energy source when switch actuated;

a switch device removably securable to said housing, said switch device including a first switch and a second switch connected in said circuit when said switch device is secured to said housing, said switch device including a switch actuator having a first position for actuating said first switch to cause said first electrical device to be energized by the energy source, a second position for actuating said second switch to cause said second electrical device to be energized by the energy source, and a third position for simultaneously actuating said first and second switches to cause said first and second electrical devices to be energized by the energy source, said switch device including a wall having arcuate openings therethrough and about electrical contacts of said first and second switches, said arcuate openings for receiving said segments and effecting contact between said contacts of said wall and said contacts of said housing; and a knob adapted to cooperate with said segments for securing said wall to said housing when said segments are received by said arcuate openings.

14. The electrical appliance according to claim 13, including:

a constant ON/OFF switch carried by said housing and connected in said circuit for permitting the energy source to energize said first electrical device independently of said switch device.

15. The electrical appliance according to claim 13, wherein:

said first and second switches are momentary switches.

16. The electrical appliance according to claim 13, wherein:

said switch device includes a pin projecting from said wall of said switch device; and said housing includes a bore receiving said pin when said cylindrical segments are received by said arcuate openings.

17. An electrical appliance, comprising the combination of:

a housing;

a first electrical device carried by said housing;

a second electrical device carried by said housing;

an electrical circuit carried by said housing for energizing said electrical devices by an electrical energy source when switch actuated;

a switch device removably securable to said housing, said switch device including a first switch and a second switch connected in said circuit when said switch device is secured to said housing, said switch device including a switch actuator having a first position for actuating said first switch to cause said first electrical device to be energized by the energy source, a second position for actuating said second switch to cause said second electrical device to be energized by the energy source, and a third position for simultaneously actuating said first and second switches to cause said first and second electrical devices to be energized by the energy source;

said switch device including a frame and a pivot shaft secured to said frame, said first and second switches supported by said frame on opposite sides of said pivot shaft; and said switch actuator including first and second wings extending from opposite sides of a longitudinal spine pivotable about said pivot shaft in a first rotational direction when a first force is applied to said first wing for actuating said first switch, said spine being pivotable about said pivot shaft in a second rotational direction when a second force is applied to said second wing for actuating said second switch, said actuator being translatable when a third force is applied to said spine for simultaneously causing said first wing to actuate said first switch and said second wing to actuate said second switch.

18. The electrical appliance according to claim 17, wherein:

said switch actuator includes at least one collar along said spine pivotally supported with respect to said pivot shaft.

19. The electrical appliance according to claim 18, wherein:

an inside diameter of said at least one collar is greater than the diameter of said pivot shaft for effecting rolling contact between said at least one collar and said pivot shaft when the first force is applied to said first wing and alternatively when the second force is applied to said second wing, and for effecting translation of said at least one collar with respect to said pivot shaft when the third force is applied to said spine.

20. An electrical appliance, comprising the combination of:

a housing;

an electrical device carried by said housing;

an electrical circuit carried by said housing for energizing said electrical device by an energy source when switch actuated;

cylindrical segments projecting from said housing and separated by a longitudinal slot, said segments encircling electrical contacts of said circuit;

a switch device removably securable to said housing, said switch device including a switch connected in said circuit when said switch device is secured to said housing, said switch device including a wall having arcuate openings therethrough and about electrical contacts of said switch, said arcuate openings for receiving said segments and effecting contact between said contacts of said wall and said contacts of said housing; and a knob adapted to cooperate with said segments for securing said wall to said housing when said segments are received by said arcuate openings.

21. The electrical appliance according to claim 20, wherein:

said switch device includes a pin projecting from said wall of said switch device; and said housing includes a bore receiving said pin when said cylindrical segments are received by said arcuate openings.

* * * * *